United States Patent [19]

Miller

[11] Patent Number: 4,974,737

[45] Date of Patent: Dec. 4, 1990

[54] EXTENSION RING

[75] Inventor: Daniel R. Miller, Cincinnati, Ohio

[73] Assignee: Buckhorn, Inc., Milford, Ohio

[21] Appl. No.: 496,607

[22] Filed: Mar. 21, 1990

[51] Int. Cl.[5] ..... B65D 6/00

[52] U.S. Cl. ..... 220/4 A; 206/501

[58] Field of Search ..... 220/4 A, 4 C, 3.94; 206/501

[56] References Cited

U.S. PATENT DOCUMENTS

| | | | |
|---|---|---|---|
| Re. 32,966 | 6/1989 | Miller et al. . | |
| 3,199,691 | 8/1965 | Lukas, Jr. | 220/4 A |
| 3,333,722 | 8/1967 | Panknin | 220/4 A |
| 3,463,345 | 8/1969 | Bockenstette . | |
| 3,883,005 | 5/1975 | Stevens | 220/4 A |
| 4,083,466 | 4/1978 | McManaway | 220/4 A |
| 4,112,984 | 9/1978 | Guglia et al. | 220/4 A |
| 4,723,679 | 2/1988 | Sinchok et al. . | |

*Primary Examiner*—Joseph Man-Fu Moy

*Attorney, Agent, or Firm*—Fay, Sharpe, Beall, Fagan, Minnich & McKee

[57] ABSTRACT

An extension ring has four panels for extending a height dimension of a box having lids hinged to the rim of the box. The lids of the box are removed, and two of the extension ring panels are secured to the rim of the box through engagement with the hinge elements of the box. The other two panels are assembled to the panels secured to the rim of the box to form the extension ring by forming pinned joints at the four corners of the extension ring. Once the extension ring is assembled and connected to the box, the lids are hinged to the top of the extension ring so that they function in the same way as when they were hinged to the box.

14 Claims, 4 Drawing Sheets

EXTENSION RING

FIELD OF THE INVENTION

The present invention relates to an extension ring for extending the height dimension of boxes with covers or lids, and more particularly to an extension ring for boxes with lids that are molded of synthetic resin and that are designed to be re-used in material handling, including shipping and storage.

DESCRIPTION OF RELATED ART

Boxes that are molded of synthetic resin are constructed to be lightweight and durable while having sufficient strength and rigidity to withstand repeated handling, including nesting and stacking of the boxes during shipment and storage. An example of such a box is disclosed in the U.S. patent to Bockenstette entitled "Lidded Tote Box", U.S. Pat. No. 3,463,245. The lids are secured to the box through hinge pins that pass through mating hinge knuckles or hinge elements provided along opposed walls of the box and corresponding hinged ends of the lid.

Lidded tote boxes of the type disclosed by Bockenstette have a unitary plastic molded construction that results in the box having a fixed capacity or size. Occasionally, it is desirable to increase the capacity of existing boxes so that a new line of boxes does not have to be purchased when a different use that requires a greater capacity of the boxes is required.

Extension rings or collars are known for extending the height of a tote box or tray in order to increase its capacity or size. Examples are disclosed in Miller et al, U.S. Pat. No. Re. 32,966 and Sinchot et al, U.S. Pat. No. 4,723,679.

SUMMARY OF THE INVENTION

It is an object of the invention to provide an extension ring for a box having lids that is connected to the hinge structure of the box after the lids are removed, and that provides corresponding hinge structure along the upper edge of the extension ring to hingedly mount the lids so that when they are hinged to the extension ring, they function in the same way as when they are hinged to the box.

It is an object of the invention to form an extension ring of a minimum number of different parts that can be assembled together to form the ring. More particularly, it is an object to provide an extension ring formed of panels that can be injection molded in one piece, and that are easily assembled together and connected to a box without the need for skilled labor or special tools.

It is an object of the invention to provide an extension ring formed of generally flat side panels and end panels for respectively extending the height dimension of the side and end walls of a box. Preferably, each of the side panels and end panels is of the same design so that only two different types of panels need be manufactured and used to construct an extension ring for a four sided box.

It is an object of the invention to construct an extension ring of a fixed height dimension that can be connected to an extension ring of a similar construction so that two, three or more extension rings can be connected to each other and fixed to a box to increase its height by one or more multiples of the fixed height dimension of the extension ring.

DESCRIPTION OF THE PREFERRED EMBODIMENT

Figure 1:
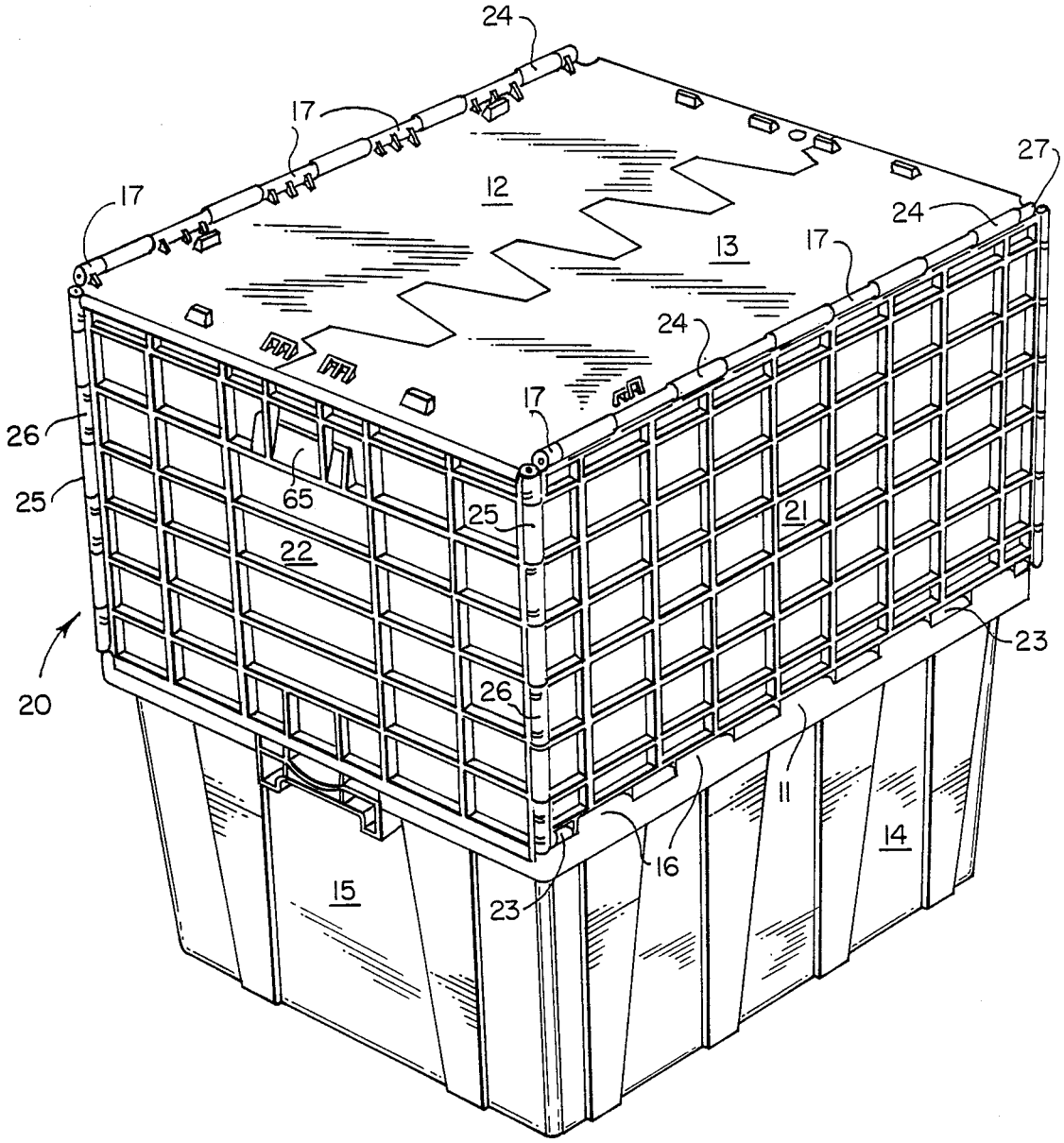
FIG. 1 is a perspective view of an extension ring constructed according to the present invention fixed to the rim of a box and having the lids of the box hinged to the top of the extension ring.

FIG. 1 shows a box 10 having the extension ring 20 of the invention connected to the rim 11 of the box to extend its height dimension. The box is provided with lids 12 and 13 that are normally hinged to the side walls 14 of the box through hinge elements 16 along the rim 11 of the box that mate with hinge elements 17 of the lid. Together, the hinge elements provide a passageway for accepting a pin (not shown) that extends through the mated hinge elements. The lids have interengaging fingers that secure the lids in a closed position. The box further has end walls 15 and a bottom wall not shown. The box and lids are of a conventional construction, and extension ring 20 can be connected to the rim of the box without structurally modifying the box once the lids are removed, and the lids can be hinged to the top of the extension ring without structurally modifying the lids, as explained in greater detail hereinafter.

Extension ring 20 is constructed of four panels, two side panels 21 and two end panels 22. Each of the side panels is interchangeable as are the end panels so that the extension ring is made of only two different parts. This reduces the production and packaging costs associated with manufacturing the extension ring.

The side panels 21 have hinge elements 23 that mate with the hinge elements 16 of the box. Along the top edge of the side panels, hinge elements 24 are provided that are to mate with the hinge elements 17 of the lid. Thus, to assemble the extension ring 20 on the box 10, the lids 12 and 13 are removed from the box and the extension ring is secured to the rim of the box through the engagement of hinge elements 23 of the side panels and hinge elements 16 of the box. The hinge elements 23 are of the same type as the hinge elements 16 in that a passageway is provided for a pin to extend between the mated hinge elements to form a pinned joint. Therefore, the pin that normally forms the hinged joint between the hinge elements of the box and the lid can be removed and used to form the pinned joint between the side panels of the extension ring and the box.

Once the side panels are connected to the box, the end panels 15 are connected to the side panels by a pin (not shown) extending through mating hinge elements 25 along the side edge of side panels 21 and hinge elements 26 along the side edge of end panels 22. The side edge connection between hinge elements 25 and 26 forms corners 27 of the extension ring. The mating hinge elements 25 and 26 at the corners 27 of the extension ring provide a strong joint between the side and end panels that in combination with the pinned joint between hinge elements 16 and 23 provides a rigid extension ring for supporting the lids and for extending the side and end walls of the box.

In forming the pinned or hinged joints used in assembling the extension ring together and connecting it to the box, a pin is driven axially through the aligned or mated hinge elements. The pin is axially secured at one end to an end hinge element by forming a bend in the pin that is force fit into the hinge element. In this way, the pin is prevented from sliding out during use.

Figure 2:
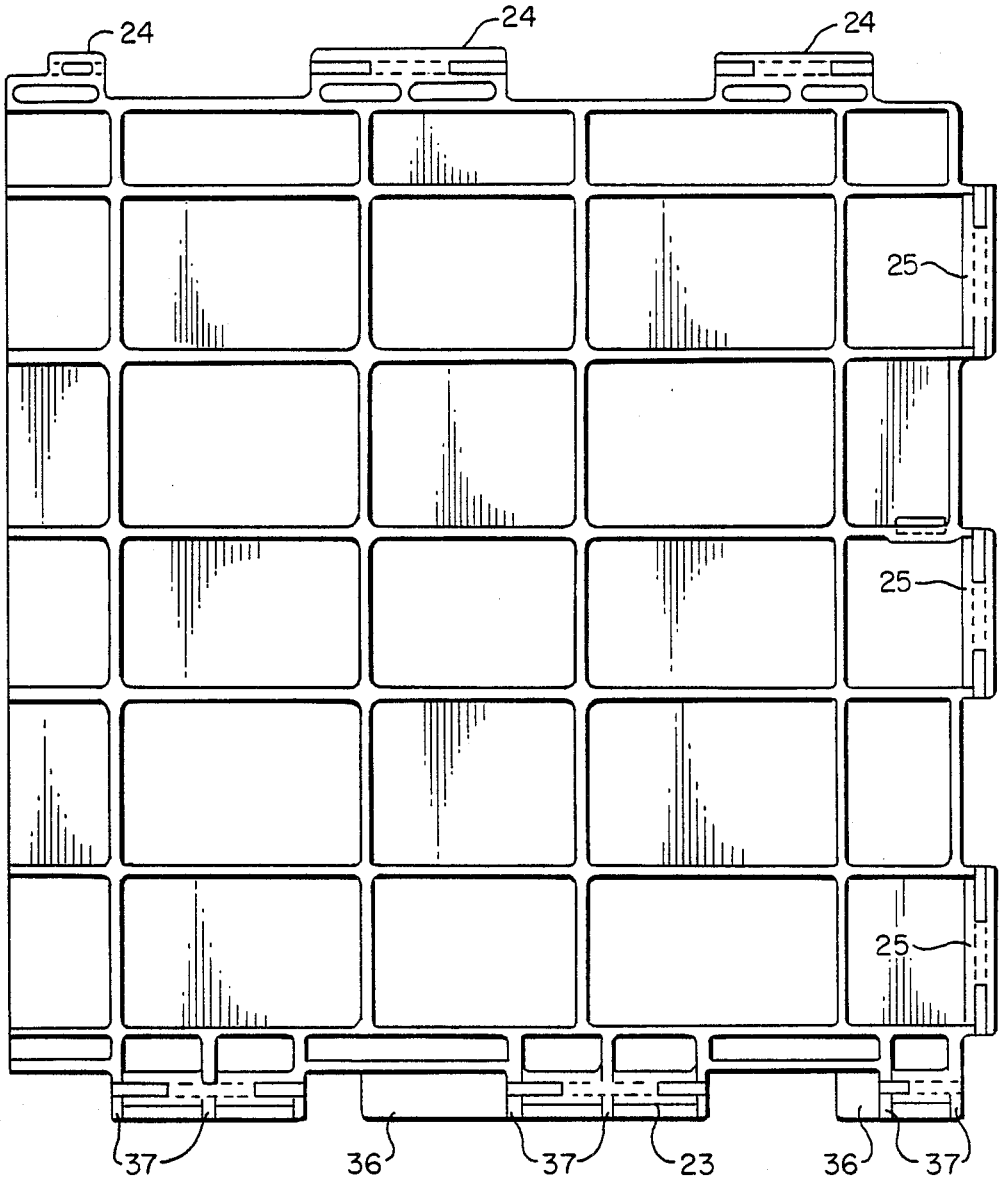
FIG. 2 is a side elevation view of one half of a side panel of the extension ring of the invention, the other half being a mirror image thereof.
Figure 5:
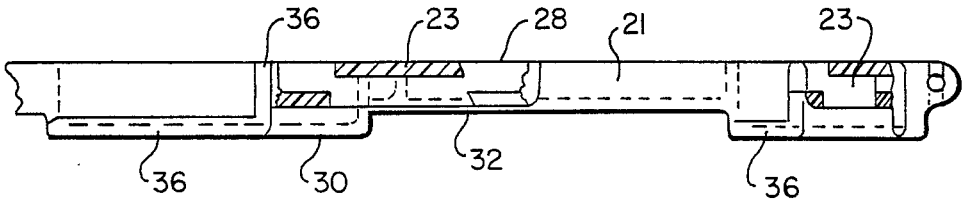
FIG. 5 is a bottom view partially in section of a portion of the side panel shown in FIG. 2.
Figure 8:
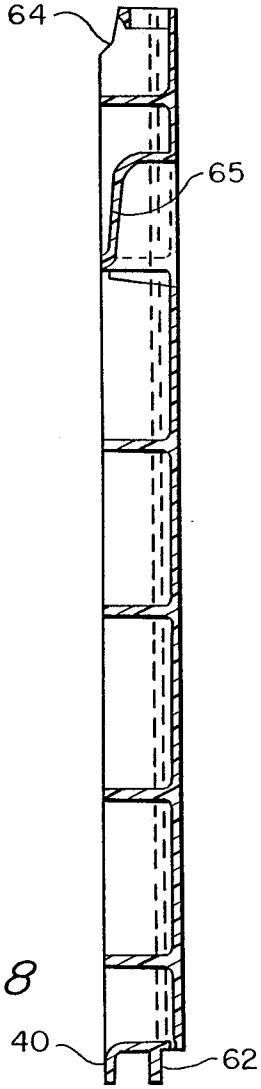
FIG. 8 is a cross sectional view taken along line 8—8 in FIG. 6.
Figure 6:
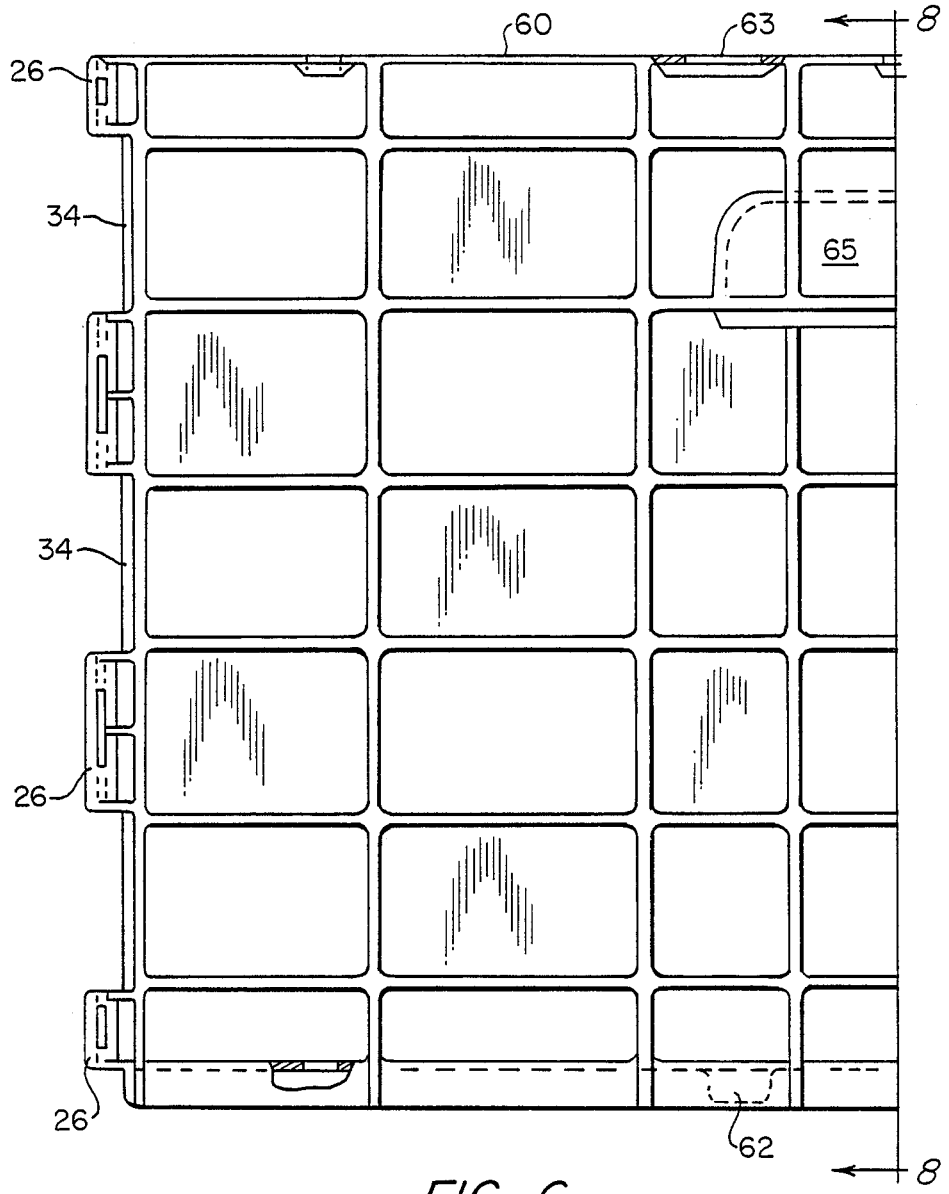
FIG. 6 is a side elevation of one half of an end panel of the extension ring of the present invention, with the other half being a mirror image thereof.
Figure 7:
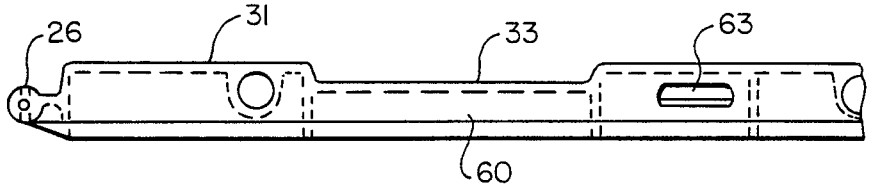
FIG. 7 is a top view of one half of an end panel corresponding to the view shown in FIG. 6.

FIGS. 2–5 show additional details of the construction of side panels 21, while FIGS. 6–8 show details of the construction of end panels 22. Each of the panels 21 and 22 is constructed to be generally flat. Panels 21 and 22 have exterior or outwardly facing sides 28 and 29, respectively. These exterior facing sides have a grid work of ribs extending horizontally and vertically to strengthen the panels, as shown in FIGS. 2 and 6, respectively. On the other hand, the interior facing sides 30 and 31 of the panels, respectively, are generally planar, and have wide recessed portions 32 and 33, respectively extending vertically from the top edge to the bottom edge of each panel. Thereafter the panels have strength and rigidity, and are made generally flat, which is preferable from the viewpoint of production and packaging.

The panels are preferably of an injection molded construction, and made from a synthetic resin material. The hinge elements are molded with the panels. The hinge elements along the side edges of each of the panels are generally the same, with the difference being that hinge elements 25 of the side panel are complementary with the hinge elements 26 of the end panels so that hinge elements 25 and 26 mate with each other.

Along the bottom edge of side panels 21, the hinge elements 23 are constructed to mate with the hinge elements 16 of the box and to engage the rim 11 of the box for structural support. As shown in FIGS. 2 and 5, the bottom edge of each side panel has flanges 36 that are intended to border the hinge elements 16 of the box. Preferably each flange 36 has a terminal edge portion that engages the rim of the box, extending in the direction of the hinge and transversely thereto. This supports the side panels on the rim of the box, and prevents them from pivoting about the hinged joint. Also, as shown in FIG. 2, ribs 37 extend downwardly from hinge elements 23 to engage rim 11 of the box. These ribs extend in the transverse direction to the hinged joint to provide support for the side panel hinge elements and to prevent rotation of the side panels about the hinge joint.

The extension ring is assembled to a box by connecting the side panels 21 onto the rim of the box by the aforementioned pinned joint connection between the mating hinge elements 23 and 16. With the side panels in place, the end panels are joined at corners 27 to the side panels by sliding a pin through the mating hinge elements 25 and 26. Once the side and end panels have been assembled together, the lids that have been removed from the box can be hinged to the top edge of the side panels 21 through mating engagement of hinge elements 24 of the side panels and 17 of the lid. Preferably, the hinge elements 24 of the side panels are patterned after the hinge elements 16 of the box so that the lids are readily assembled to the top edge of side panels 21 to provide a hinged connection between the lids and the side panels. Further, it is preferred that the side panels and end panels have the same dimensions as the rim of the box so that no interference will be caused in interengaging the fingers of the lids upon securing the lids in a closed position along the rim of the extension ring.

Along the bottom edge of each end panel, as shown in FIGS. 6 and 8, a flange 40 is provided that extends over the outer edge of rim 11. This flange reinforces the end panel when the extension ring is connected to the box by preventing the end panel from collapsing inwardly. Furthermore, flange 40 prevents the end panel from being flexed or warped once the extension ring is connected to the box. Thus, entry into the box from the joint between the bottom edge of the end panel and the rim 11 is prevented.

Figure 4:
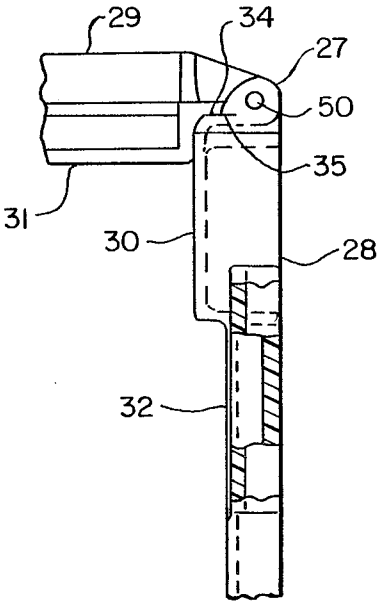
FIG. 4 is a top view, partially in section of a portion of a side panel and end panel joined together at one one corner of the extension ring of the invention.

At the corners 27 of the extension ring 20, the end panels 22 have a side edge flange 34, as shown in FIGS. 4 and 6. The side edges 35 of side panels 21 abut the side edge flanges 34 of the end panels, as shown in FIG. 4. This preferred arrangement provides a secure corner joint for the extension ring.

Figure 3:
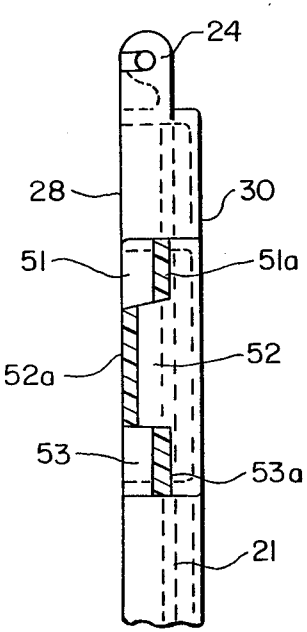
FIG. 3 is a right side view partially in section of a portion of the side panel shown in FIG. 2.

FIG. 3 shows a side view, partially in section, of a portion of side panel 21. The structure of hinge element 25 is shown. Each of the side edge hinge elements 25 and 26 for the side and end panels, respectively, have generally the same construction, which includes a central passageway made up of three adjacent channels. As shown in FIG. 3, for the side edge hinge elements 25, channels 51 and 53 open toward the exterior side of the panel, whereas channel 51 opens toward the interior side of the panel. The bottom walls of the channels 51*a*, 52*a*, and 53*a* are shown in section in FIG. 3. The uppermost and lowermost hinge elements 26 of the end panels, as shown in FIG. 6, have one half of the overall dimension of the other hinge elements so that hinge elements 25 and 26 will mate with each other.

Only one extension ring is shown in FIG. 1 as having been connected to box 10. However, additional extension rings can be added to each other in order to further increase the height dimension of a box. The hinge elements 23 of the side panels are designed to mate with the hinge elements 24 along the top edge of the side panels so that a second set of side panels can be connected through the mating hinge elements to connect two extension rings together.

The top and bottom edge structure of end panels 22 are also constructed so that two extension rings can be connected together with a secure connection between the end panels of the upper and lower extension rings. As shown in FIGS. 6–8, the top and bottom edges 60 and 61 of the side end panels are generally flat so that an upper end panel can be stacked onto a lower one. Further, end panel 22 has a pair of tabs 62, only one of which is shown in FIG. 6, that extend downwardly from the bottom edge 61 of the end panel, and that are adapted to be received within a corresponding aligned pair of slots, only one of which is shown in FIG. 6, in the top edge 60 of the side panel. Also, as shown in FIG. 8, flange 36 projects downwardly from bottom edge 61 so a recess 64 is provided to accept flange 36. Thus, when two end panels are stacked one on top of the other as when two extension rings are connected to each other, the flanges 36 of the top end panels are received within the recesses 64 of the lower end panels. A secure joint is therefore provided between the bottom edge of an end panel of an upper extension ring when it is connected to the top edge of an end panel of a lower extension ring.

After the extension ring is connected to the box, the lids function in the same way as when they were hinged to the box. Further, handles 65 in the end panels 22 of the extension ring allow the box to be conveniently handled as a regular container. Neither the box nor the lids need to be structurally altered in order to connect the extension ring to the box, and no specially designed tools are required to assemble the extension ring onto the box.

While a preferred embodiment has been described structurally and functionally in detail for the advantages thereof, other embodiments, modifications and variations are contemplated within the broad aspects of the present invention, all of which are defined by the spirit and scope of the following claims.

I claim:

1. An extension ring for extending a height dimension of a box having a bottom, serially connected side and end walls extending upwardly from the bottom, a rim, and a pair of lids for closing the box; said extension ring being for a box having first hinge elements along an uppermost edge of both side or both end walls adjacent the rim that mate with second hinge elements along an edge of each of the lids, said first and second hinge elements receiving a hinge pin therebetween for pivotally mounting the lids on the box, comprising:

said extension ring have a pair of first panels for extending the height of one of said side and end walls and a pair of second panels for extending the height of the other of said end and side walls, each of said panels being generally flat and having side edges, a bottom edge and a top edge;

each of said first panels having means along said bottom edge for connecting said first panels to said first hinge elements of a box after the lids have been removed from the box, and having third hinge elements along said top edge for mating with said second hinge elements of each of the lids to receive a hinge pin therebetween for pivotally mounting each lid to a corresponding one of the first panels, respectively;

each of said first and second panels having side edge connecting means for serially connecting the side edges of said first and second panels together to form corners of said extension ring whereby said first and second panels increase a height dimension of a corresponding one of the walls of a box, respectively.

2. An extension ring according to claim 1, wherein said means along said bottom edge of each of first panels for connecting said first panels to said first hinge elements is fourth hinge elements adapted that mate with said first hinge elements so that said first and fourth hinge elements receive a pin therebetween to form a pinned joint, and wherein each of said first panels has means for engaging a portion of the rim of the box for resisting pivoting motion about said pinned joint.

3. An extension ring according to claim 1, wherein said side edge connecting means comprises at a corner of said mating hinge elements along each adjacent one of said side edges of each of said panels at said corners of said extension ring for receiving a pin therebetween to form a pinned joint at each of said corners.

4. An extension ring according to claim 1, wherein the bottom edge of each of said second panels has a generally flat bottom portion for engaging a rim of the box and wherein each of said second panels further has a flange extending downwardly from said bottom edge to extend over an edge of the rim of a box.

5. An extension ring according to claim 1, wherein each of said panels is of unitary injection molded synthetic resin and whereby each of said hinge elements has a passageway extending therethrough formed from at least two adjacent channels opening in opposite directions such that said passageway captures said pin.

6. An extension ring according to claim 1, further comprising said means for connecting said first panels to said first hinge elements of a box further being for connecting said first panels of a second extension ring to said third hinge elements of said first panels of a first extension ring when a second extension ring is connected to a first extension ring to extend a height dimension of a box by a height dimension of two of said extension rings.

7. An extension ring according to claim 6, wherein said second panels have at least one tab projecting downwardly from said bottom edge and have at least one correspondingly aligned slot projecting through said top edge for receiving said tab when said second extension ring is connected to said first extension ring.

8. An extension ring according to claim 6, wherein said second panels have a flange extending downwardly from said bottom edge for overlying an edge of a rim of the box, and said second panels further have a recess adjacent said top edge for receiving said bottom edge flange of a corresponding said side panel of a second extension ring when said second extension ring is connected to said first extension ring.

9. An extension ring according to claim 1, wherein said first panels are side panels for extending the height dimension of said side walls of a box and said second panels are end panels for extending a height dimension of the end walls of a box, and each of said end panels have a hand grip molded therein.

10. An extension ring according to claim 2, wherein said means for engaging a portion of the rim of the box includes at least one bottom edge flange bordering at least one of said first hinge elements of the box, and further includes ribs extending transversely with respect to a direction of extension of the pin wherein said ribs have bottom edge portions engaging the rim of the box.

11. An extension ring according to claim 1, wherein said generally flat panels have exterior and interior facing sides, and said exterior facing side has a plurality of ribs extending in a grid work to strengthen said panel.

12. An extension ring according to claim 1, wherein said generally flat panels have exterior and interior sides, wherein said interior facing sides are generally planar and have recessed surfaces for strengthening said panel.

13. An extension ring according to claim 1, wherein each of said panels has a unitary synthetic resin injection molded construction, and wherein each of said hinge elements has a passageway extending therethrough formed from at least two adjacent channels opening in opposite directions such that said passageway captures said pin, and wherein each of said hinge elements has reinforcing ribs extending transversely to an extending direction of said passageway for reinforcement, each of said ribs extending downwardly and having a bottom edge portion flush with said bottom edge of said panel for engaging said rim to resist pivoting movement about said pin joint between said first panels and the box.

14. An extension ring according to claim 3, wherein said second panels have flanges extending outwardly along each of said side edges, and said side edges of said first panels abut said flanges along each of said corners.

* * * * *